US011835275B2

(12) United States Patent
Cluff

(10) Patent No.: US 11,835,275 B2
(45) Date of Patent: Dec. 5, 2023

(54) COOLING SYSTEM AND METHOD OF OPERATING A COOLING SYSTEM

(71) Applicant: Carrier Corporation, Palm Beach Gardens, FL (US)

(72) Inventor: Charles A. Cluff, Indianapolis, IN (US)

(73) Assignee: Carrier Corporation, Palm Beach Gardens, FL (US)

( * ) Notice: Subject to any disclaimer, the term of this patent is extended or adjusted under 35 U.S.C. 154(b) by 618 days.

(21) Appl. No.: 16/976,850

(22) PCT Filed: Aug. 7, 2020

(86) PCT No.: PCT/US2020/045328

§ 371 (c)(1),
(2) Date: Aug. 31, 2020

(87) PCT Pub. No.: WO2021/030169

PCT Pub. Date: Feb. 18, 2021

(65) Prior Publication Data

US 2023/0152016 A1 May 18, 2023

Related U.S. Application Data

(60) Provisional application No. 62/884,725, filed on Aug. 9, 2019.

(51) Int. Cl.
*F25B 43/00* (2006.01)
*F25B 49/02* (2006.01)

(52) U.S. Cl.
CPC ..... *F25B 43/006* (2013.01); *F25B 49/02* (2013.01); *F25B 2500/28* (2013.01); *F25B 2700/1353* (2013.01); *F25B 2700/2113* (2013.01)

(58) Field of Classification Search
CPC ..... F25B 2700/1353; F25B 2700/2113
See application file for complete search history.

(56) References Cited

U.S. PATENT DOCUMENTS 3,938,349 A * 2/1976 Ueno ..... F25B 40/00 62/503
4,794,763 A 1/1989 Kikuchi
(Continued)

FOREIGN PATENT DOCUMENTS

| | | |
|---|---|---|
| EP | 1215452 | 6/2002 |
| EP | 3273185 | 1/2018 |
| WO | 2017175014 | 10/2017 |

OTHER PUBLICATIONS

The International Preliminary Report on Patentability for International Patent Application No. PCT/US2020/045328 dated Feb. 17, 2022.

(Continued)

*Primary Examiner* — Henry T Crenshaw
(74) *Attorney, Agent, or Firm* — Carlson, Gaskey & Olds, P.C.

(57) ABSTRACT

A cooling system includes a compressor operable to compress refrigerant, an accumulator upstream from the compressor. The accumulator is operable to collect liquid from the refrigerant. A sensor is located upstream from the accumulator. The sensor is operable to detect information including a temperature and a pressure of the refrigerant. The controller is in communication with the sensor. The controller is operable to determine a rate of accumulation of liquid in the accumulator based on the information from the sensor. A method of operating a cooling system is also disclosed.

16 Claims, 2 Drawing Sheets

(56) References Cited

U.S. PATENT DOCUMENTS

| | | | | |
|---|---|---|---|---|
| 5,209,076 | A | 5/1993 | Kauffman et al. | |
| 5,253,481 | A | 10/1993 | Takagi et al. | |
| 5,691,466 | A | 11/1997 | Lawrence et al. | |
| 6,073,453 | A | 6/2000 | Karl | |
| 6,578,373 | B1 | 6/2003 | Barbier | |
| 7,146,819 | B2 | 12/2006 | Demuth et al. | |
| 7,752,853 | B2 | 7/2010 | Singh et al. | |
| 8,006,504 | B2 | 8/2011 | Ko et al. | |
| 8,849,604 | B2 | 9/2014 | Rowe, Jr. | |
| 8,919,139 | B2 | 12/2014 | Yamada et al. | |
| 9,476,625 | B2 | 10/2016 | McSweeney | |
| 9,494,158 | B2 | 11/2016 | Pham et al. | |
| 9,791,175 | B2 | 10/2017 | Senf, Jr. | |
| 9,915,436 | B1 * | 3/2018 | Feria | F24D 19/1087 |
| 2009/0126375 | A1 * | 5/2009 | Toyoshima | F25B 49/005 62/529 |
| 2010/0236264 | A1 | 9/2010 | Lifson et al. | |
| 2014/0308138 | A1 * | 10/2014 | Pham | F04C 28/06 417/63 |
| 2015/0204592 | A1 * | 7/2015 | Iwasaki | F24F 11/30 62/190 |
| 2016/0245536 | A1 * | 8/2016 | Iwasaki | F25B 49/02 |
| 2017/0016659 | A1 * | 1/2017 | Chen | F25B 13/00 |
| 2018/0023870 | A1 * | 1/2018 | Ohura | F25B 43/02 62/195 |
| 2018/0106520 | A1 | 4/2018 | Wallis et al. | |
| 2020/0292207 | A1 * | 9/2020 | Feria | F24H 9/133 |

OTHER PUBLICATIONS

The International Search Report and Written Opinion for International Patent Application No. PCT/US2020/045328 dated Oct. 26, 2020.

* cited by examiner

COOLING SYSTEM AND METHOD OF OPERATING A COOLING SYSTEM

CROSS-REFERENCE TO RELATED APPLICATIONS

This application claims priority to U.S. Provisional Application No. 62/884,725, which was filed on Aug. 9, 2019 and is incorporated herein by reference.

BACKGROUND

The disclosure relates to a compressor and method of protecting a compressor during operation. More particularly, this disclosure relates to a compressor in a cooling system, such as a cooling unit in a building.

A typical cooling system includes an evaporator, a compressor, a condenser, and an expansion valve. In the evaporator, heat is transferred from air in the environment to be cooled to a refrigerant to cool the air as the refrigerant evaporates (e.g., enters the vapor phase). The vapor refrigerant is then compressed (pressurized) in the compressor. The high-pressure gaseous refrigerant is then condensed in a condenser. As the vapor refrigerant condenses (e.g., enters the liquid phase), it transfers heat to air outside of the environment to be cooled. Finally, the liquid refrigerant is passed through an expansion valve to reduce its pressure. As the pressure is reduced, some of the liquid flashes to vapor creating a saturated fluid consisting of both vapor and liquid refrigerant. The low pressure refrigerant fluid flows back to the evaporator.

Occasionally, less than all of the liquid refrigerant may evaporate in the evaporator, leaving liquid refrigerant in the refrigerant stream that subsequently enters the compressor. Liquid can interfere with compressor operation and lifetime.

SUMMARY

A cooling system according to an exemplary embodiment of this disclosure, among other possible things includes a compressor operable to compress refrigerant, an accumulator upstream from the compressor. The accumulator is operable to collect liquid from the refrigerant. A sensor is located upstream from the accumulator. The sensor is operable to detect information including a temperature and a pressure of the refrigerant. The controller is in communication with the sensor. The controller is operable to determine a rate of accumulation of liquid in the accumulator based on the information from the sensor.

In a further example of the foregoing, the controller includes an integrator. The controller is operable to determine an amount of time to reach a maximum liquid capacity of the accumulator via the integrator.

In a further example of any of the foregoing, the integrator is an asymmetrical integrator.

In a further example of any of the foregoing, the controller is operable to determine a rate of vaporization of the liquid in the accumulator.

In a further example of any of the foregoing, the sensor is operable to detect a flowrate of the refrigerant.

In a further example of any of the foregoing, the sensor is a first sensor, and the system further includes a second sensor downstream from the compressor and is in communication with the controller. The second sensor is operable to determine a temperature and pressure of the refrigerant.

In a further example of any of the foregoing, the controller is operable to detect a superheat condition of the refrigerant based on information from at least one of the first and second sensors.

In a further example of any of the foregoing, the controller is operable to detect a failure mode of the cooling system based on information from at least one of the first and second sensors.

In a further example of any of the foregoing, the refrigerant flows past the sensor and to the accumulator in a conduit. The conduit is less than 12 inches (30.48 cm) in length.

In a further example of any of the foregoing, the compressor is a high-side rotary compressor.

A method of operating a cooling system according to an exemplary embodiment of this disclosure, among other possible things includes detecting a temperature and a pressure of refrigerant upstream of an accumulator. The accumulator is operable to collect liquid in the refrigerant and is upstream of a compressor. The method also includes determining a rate of accumulation of liquid in an accumulator based on the detected temperature and pressure.

In a further example of the foregoing, the method includes determining an amount of time to reach a maximum liquid capacity of the accumulator based on the rate of accumulation of liquid.

In a further example of any of the foregoing, a rate of vaporization of liquid in the accumulator is determined.

In a further example of any of the foregoing, an amount of time to reach a maximum liquid capacity of the accumulator based on the rate of accumulation of liquid and the rate of vaporization of liquid is determined.

In a further example of any of the foregoing, a failure mode of the cooling system based is detected based on the detected temperature and pressure.

In a further example of any of the foregoing, a second temperature and a second pressure are detected of the refrigerant downstream from the compressor.

In a further example of any of the foregoing, the method includes determining whether the accumulator is empty based at least in part on the second temperature and the second pressure.

In a further example of any of the foregoing, a resolution process is performed if the accumulator is empty.

In a further example of any of the foregoing, a control command is implemented to shut down the compressor if the accumulator reaches a maximum liquid capacity.

In a further example of any of the foregoing, the the compressor is a high-side rotary compressor.

DETAILED DESCRIPTION

Figure 1:
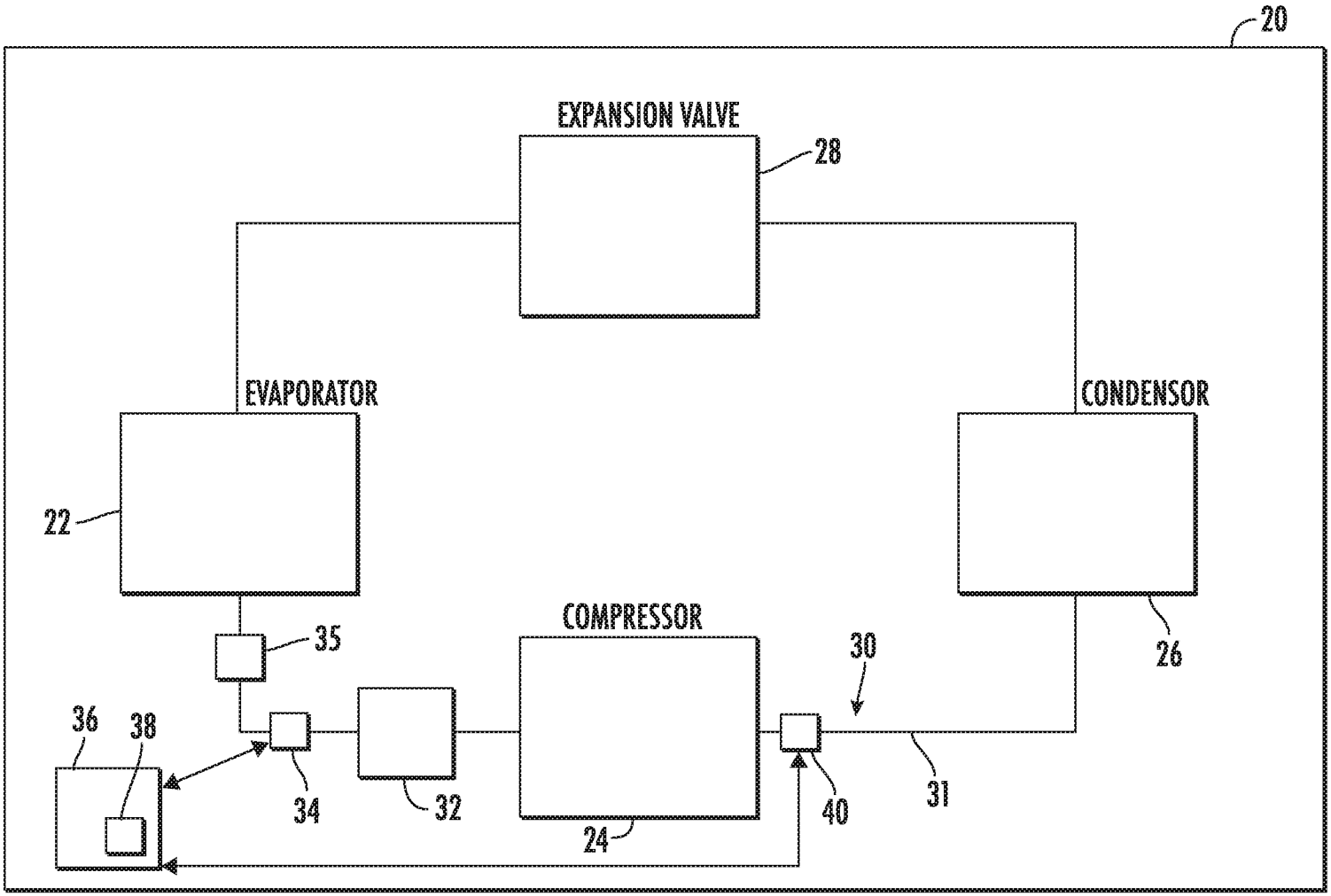
FIG. 1 schematically shows a cooling system.

FIG. 1 shows cooling system 20. The cooling system 20 includes an evaporator 22, a compressor 24, a condenser 26, and an expansion valve 28. Refrigerant 30 is configured to flow through conduits 31 that joins the various components of the cooling system 20. As refrigerant 30 flows through the evaporator 22, heat is transferred from air in the environment to the refrigerant 30 causing the refrigerant 30 to evaporate (e.g., enters the vapor phase). The vapor refrigerant 30 is then compressed (pressurized) in the compressor 24. The high-pressure vapor refrigerant 30 is then condensed in the condenser 26. As the vapor refrigerant 30 flows through the condenser (e.g., enters the liquid phase), a condenser fan operates to blow ambient outdoor air across the condenser causing heat transfer between the refrigerant 30 and the air outside. Finally, the warm liquid refrigerant 30 is passed through an expansion valve 28 to reduce its pressure, and the low pressure refrigerant fluid flows back to the evaporator 28.

The compressor 24 can be any known type of compressor. For instance, the compressor 24 can be a scroll compressor or a rotary compressor. The compressor 24 can be either a high-side compressor or a low-side compressor. In a particular example, the compressor 24 is a high-side rotary compressor.

In one example, the cooling unit 20 is part of an air conditioner for a building, such as a residential building. In this example, the environment to be cooled is the interior of the residential building.

As the cooling unit 20 operates, occasionally, less than all of the liquid refrigerant 30 evaporates in the evaporator 22, leaving liquid mixed with vapor in the refrigerant 30 as it enters the compressor 24. An accumulator 32 is arranged between the evaporator 22 and the compressor 24. The accumulator 32 separates liquid from the refrigerant 30 and collects it within the accumulator 32 to substantially eliminate liquid in the refrigerant 30 as it enters the compressor 24. Liquid may impede the operation of the compressor 24 and/or decrease its operational lifetime.

In one operating scenario, such as during installation or repair of the cooling system 20, a service technician may need to add a large amount of refrigerant 30 to the system 20 while it is operating. This is known as a "charging mode." In one example, the refrigerant is added to the system at a vapor service valve 35. At the vapor service valve 35, refrigerant 30 in the conduit 31 is typically mostly or all vapor during normal system 20 operation. The accumulator 32 has a finite capacity for liquid storage. If the accumulator 32 overflows, liquid could enter the compressor 24. A system and method for operating the cooling system 20 and/or the compressor 24 so as to minimize the amount of liquid entering the compressor 24, or prevent liquid from entering the compressor 24 to protect the compressor 24 is discussed below.

A sensor 34 is arranged upstream from the accumulator 32. The sensor 34 is configured to measure the temperature and pressure of refrigerant 30 before it enters the accumulator 32. The sensor 34 can include any known type of pressure and temperature sensor. In one example, the sensor 34 is arranged so that the conduit 31 that separates the accumulator 32 from the sensor 34 is less than 12 inches (30.48 cm) in length.

The sensor 34 may also sense other characteristics of the refrigerant 30 flow, such as its flowrate. In this example, the sensor 34 includes any known type of flowrate sensor.

A controller 36 is operably connected with the sensor 34. In one embodiment, the controller 36 may be wired to the sensor 34. In another embodiment, the controller 36 may communicate with the sensor 34 wirelessly. The controller 36 includes processors or other devices that are programmed so that the controller 36 is operable to analyze data from the sensor 34. In particular, the controller 36 is operable to determine the amount of liquid in the refrigerant 30 based on the measured temperature and pressure from the sensor 34 and known phase characteristics of the refrigerant 30.

Figure 2:
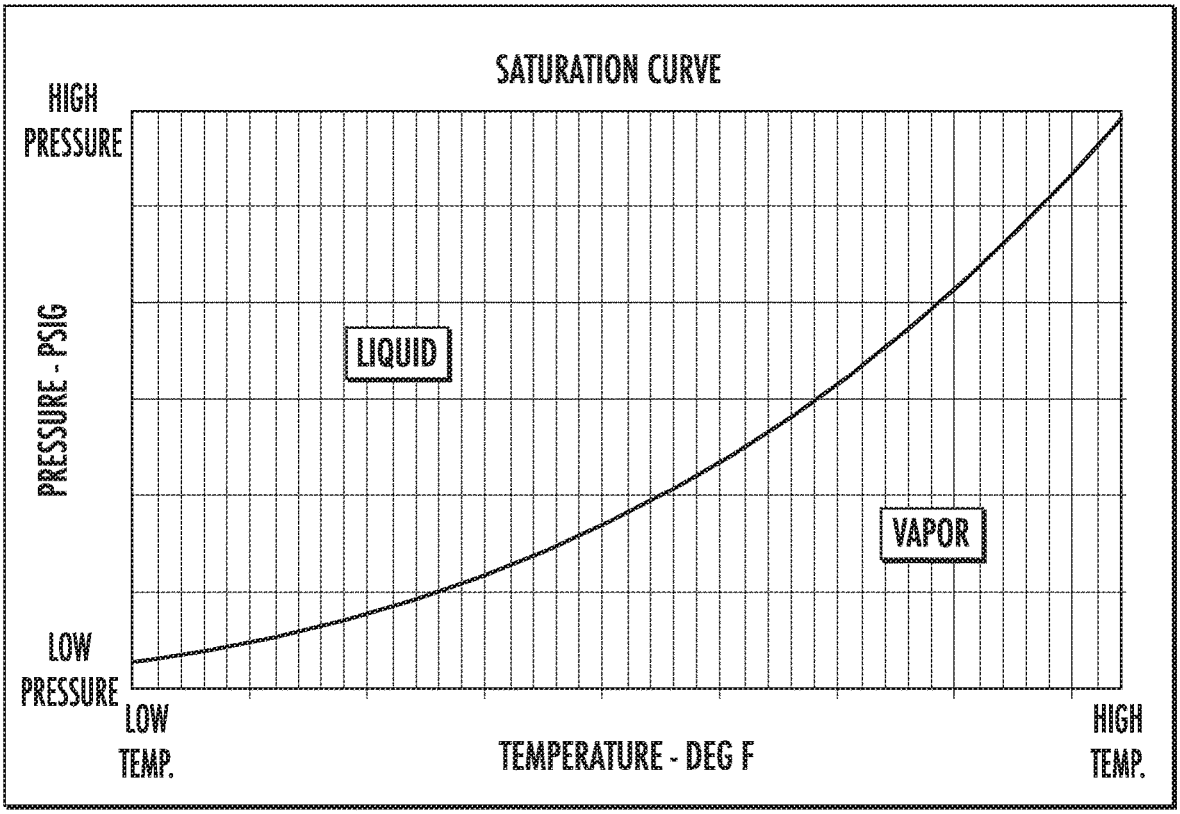
FIG. 2 shows a saturation curve for an example refrigerant.

For each refrigerant, there exists a saturation curve, which is a pressure/temperature relationship that corresponds to the phases of the refrigerant. FIG. 2 shows a saturation curve for an example refrigerant. For any given temperature, there is a corresponding pressure at which the refrigerant exists in a state that may include a mixture of liquid and vapor phases, as represented by the curve in FIG. 2. At higher pressures, the refrigerant is entirely liquid. At lower pressures, the refrigerant is entirely vapor. This is also known as a "superheated" condition. Based on the saturation curve for the particular refrigerant 30, the temperature and pressure information from the sensor 34, the controller 36 can determine whether liquid may be present in the refrigerant 30 stream, e.g., what phase the refrigerant 30 is in. The controller 36 is also operable to estimate an amount of liquid in the refrigerant 30 stream (if any) based on experimental data that is pre-programmed into the controller. The controller 36 is also operable to estimate a rate of accumulation of liquid in the accumulator 32, and, relatedly, an estimated amount of liquid in the accumulator 32, by analyzing the amount of liquid in the refrigerant 30 and the flowrate of the refrigerant 30, which can also be measured by the sensor 34 as discussed above.

The controller 36 is pre-programmed with a maximum liquid capacity of the accumulator 32. The programmed maximum liquid capacity of the accumulator 32 may be less than the total volume of the accumulator 32 in order to avoid overflow of the accumulator 32. The controller 36 is operable to compare the amount of liquid in the accumulator 32 with the maximum liquid capacity. For instance, if the controller 36 determines that the amount of liquid in the accumulator 32 is at the maximum liquid capacity of the accumulator 32, the controller 36 can implement a control command to shut down the compressor 24. The control command can be sent directly to the compressor 24, or to a master controller for the cooling system 20.

The controller 36 also includes an integrator 38. The integrator 38 can be a hardware device programmed to perform an integrating function, or in another example, the controller 36 itself can be programmed to perform an integrating function. Based on the amount of liquid in the refrigerant 30 and the flowrate of the refrigerant 30, the controller 36 is operable to estimate (via the integrator 38) an amount of liquid in the accumulator 32.

The amount of liquid in the accumulator 32 corresponds to an amount of time that the cooling system 20 can run before reaching the maximum capacity of the accumulator 32, e.g., without overflowing the accumulator 32. In other words, the controller 36 can determine how long it would take to fill the accumulator 32 to its maximum liquid capacity by comparing the actual fill level of the accumulator 32 at a given time as determined by the accumulator 32 with the maximum capacity of the accumulator 32 to determine a difference, and then dividing the difference by the rate of accumulation (liquid flowrate into the accumulator 32). If the cooling system 20 runtime exceeds the amount of time that the cooling system 20 can run without overflowing the accumulator 32, the controller 36 implements a control command to shut down the compressor 24. The control command can be sent directly to the compressor 24, or to a master controller for the cooling system 20.

If the cooling system 20 is in the charging mode, discussed above, liquid refrigerant can be added to the system very rapidly such that the liquid accumulator 32 would be quickly filled to capacity. As discussed above, the controller 36 is operable to send a command to shut down the compressor 24 if the accumulator 32 is at maximum liquid capacity. In this example, the command is particularly important to protect the compressor 24 because in the charging mode, there is an increased amount of liquid refrigerant 30 in the system 20 which could enter the compressor 24.

In some examples, the integrator 38 is an asymmetrical integrator. As the cooling system 20 runs, liquid in the accumulator 32 can vaporize. For instance, vaporization can occur during cooling system 20 downtime, or when conditions upstream of the accumulator 32 at sensor 34 are operating in superheat conditions (e.g, the refrigerant 30 is all vapor, as was discussed above). In this example, the integrator 38 is "asymmetrical" because the criteria for integrating up (e.g., measuring accumulation of liquid in the accumulator 32) may be different from the criteria for integrating down (e.g., measuring vaporization of liquid from the accumulator 32).

In a more particular example, superheated vapor refrigerant 30 passes through the accumulator 32, causing the liquid in the accumulator 32 to boil because the superheated vapor adds heat to the liquid refrigerant 30 in the accumulator 32, which causes at least some of the refrigerant 30 to vaporize according to the saturation curve. Therefore, the amount of liquid in the accumulator 32 will be reduced. The rate of vaporization can be determined based on data from the sensor 34, the known phase characteristics of the refrigerant 30, and/or pre-programmed experimental data, as discussed above. The asymmetrical integrator 38 is operable to take into account vaporization of refrigerant 30 in the accumulator when determining how long the cooling system 20 can operate without overflowing the accumulator 32. That is, the asymmetrical integrator 38 takes into account the rate of liquid entering the accumulator 32 from the refrigerant 30 entering the accumulator 32, and the rate of liquid leaving the accumulator 32.

In one example, a second sensor 40 is arranged near an outlet of the compressor 24 and is operable to detect information about the temperature, pressure, and/or flowrate of the refrigerant 30 as it exits the compressor 24. In general, the conditions of the refrigerant 30 at the sensor 34 and at the sensor 40 are related. For instance, if the refrigerant 30 increases in amount of superheat at the sensor 34 over time (e.g., the amount the temperature of the refrigerant 30 exceeds the saturation temperature of the refrigerant 30 at a given pressure), the amount of superheat at the sensor 40 will increase over time also, though the rates of increase may differ. The second sensor 40 is operably connected to the controller 36 to provide additional information about the refrigerant 30 to the controller 36. In one embodiment, the controller 36 may be wired to the second sensor 40. In another embodiment, the controller 36 may communicate with the second sensor 34 wirelessly. For instance, when the compressor 24 is running in superheat conditions (e.g., the refrigerant is superheated at the sensor 34 and at the sensor 40), there is substantially no liquid entering the accumulator 32. The controller 36 (via the integrator 38) can determine the amount of time the compressor 24 runs at superheat conditions and take the time into account when determining the amount of liquid in the accumulator 32 and the amount of time the cooling system 20 can run without overflowing the accumulator 32, as discussed above.

Furthermore, the controller 36 is operable to perform a resolution process when the accumulator 32 is empty. As the cooling system 20 runs, inaccuracies due to time delays in data transmission and changing conditions can build up and compound on one another, causing the time determinations discussed above to become imprecise. The resolution process resets the integrator 38 according to a known condition, e.g., the emptiness of the accumulator 32, so that previous compounded inaccuracies are reduced from the controller 36 time determinations.

In another example, the controller 36 is operable to detect certain failures within the cooling system 20 based on the information from one or both of the sensors 34, 40. One example of such a failure is failure of the expansion valve 28. If the expansion valve 28 is too open, the pressure of the liquid refrigerant 30 may not be sufficiently reduced so that all of the refrigerant 30 evaporates in the evaporator 22. In this failure mode, there will thus be accumulation of liquid in the accumulator 32 which exceeds normal accumulation levels in the normal operating mode for the cooling system 20 discussed above. In turn, the time that the cooling system 20 can run without overflow of the accumulator 32, as determined by the controller 36, will be reduced. In one example, the controller 36 is pre-programmed with a predetermined time and/or accumulation rate that indicates a failure mode. When a failure mode is detected, the controller 36 is operable to implement a control command to shut down the compressor 24 (as was discussed above).

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A cooling system comprising:

a compressor operable to compress refrigerant;

an accumulator upstream from the compressor, the accumulator operable to collect liquid from the refrigerant;

a sensor upstream from the accumulator, the sensor operable to detect information including a temperature and a pressure of the refrigerant; and a controller in communication with the sensor, the controller operable to determine a rate of accumulation of liquid in the accumulator based on the information from the sensor, wherein the controller includes an integrator, and wherein the controller is operable to determine an amount of time to reach a maximum liquid capacity of the accumulator via the integrator, and wherein the integrator is an asymmetrical integrator.

2. The system of claim 1, wherein the controller is operable to determine a rate of vaporization of the liquid in the accumulator.

3. The system of claim 1, wherein the sensor is operable to detect a flowrate of the refrigerant.

4. The system of claim 1, wherein the sensor is a first sensor, and the system further comprises a second sensor downstream from the compressor and in communication with the controller, wherein the second sensor is operable to determine a temperature and pressure of the refrigerant.

5. The system of claim 4, wherein the controller is operable to detect a superheat condition of the refrigerant based on information from at least one of the first and second sensors.

6. The system of claim 4, wherein the controller is operable to detect a failure mode of the cooling system based on information from at least one of the first and second sensors.

7. The system of claim 1, wherein the refrigerant flows past the sensor and to the accumulator in a conduit, and wherein conduit is less than 12 inches (30.48 cm) in length.

8. The system of claim 1, wherein the compressor is a high-side rotary compressor.

9. A method of operating a cooling system, including:

detecting a temperature and a pressure of refrigerant upstream of an accumulator, the accumulator operable to collect liquid in the refrigerant, wherein the accumulator is upstream of a compressor; and determining a rate of accumulation of liquid in an accumulator based on the detected temperature and pressure, detecting a second temperature and a second pressure of the refrigerant downstream from the compressor, and determining whether the accumulator is empty based at least in part on the second temperature and the second pressure.

10. The method of claim 9, further comprising determining an amount of time to reach a maximum liquid capacity of the accumulator based on the rate of accumulation of liquid.

11. The method of claim 9, further comprising determining a rate of vaporization of liquid in the accumulator.

12. The method of claim 11, further comprising determining an amount of time to reach a maximum liquid capacity of the accumulator based on the rate of accumulation of liquid and the rate of vaporization of liquid.

13. The method of claim 9, further comprising detecting a failure mode of the cooling system based on the detected temperature and pressure.

14. The method of claim 9, further comprising performing a resolution process if the accumulator is empty.

15. The method of claim 9, further comprising implementing a control command to shut down the compressor if the accumulator reaches a maximum liquid capacity.

16. The method of claim 15, wherein the compressor is a high-side rotary compressor.

* * * * *